US006552688B1

(12) United States Patent
Yoshimi

(10) Patent No.: US 6,552,688 B1
(45) Date of Patent: Apr. 22, 2003

(54) ANTENNA AND MOBILE RADIO UNIT

(75) Inventor: Akitoshi Yoshimi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/890,259

(22) PCT Filed: Dec. 9, 1999

(86) PCT No.: PCT/JP99/06900

§ 371 (c)(1),
(2), (4) Date: Aug. 7, 2001

(87) PCT Pub. No.: WO01/43227

PCT Pub. Date: Jun. 14, 2001

(51) Int. Cl.[7] ..... H01Q 1/24; H01Q 1/10
(52) U.S. Cl. ..... 343/702; 343/901
(58) Field of Search ..... 343/702, 900, 343/901, 895, 889; H01Q 1/24, 1/10

(56) References Cited

U.S. PATENT DOCUMENTS 5,243,355 A 9/1993 Emmert et al. ..... 343/702
5,583,519 A 12/1996 Koike ..... 343/702
5,757,337 A 5/1998 Hsueh et al. ..... 343/901
5,949,377 A * 9/1999 Matsumoto et al. ..... 343/702
6,034,639 A * 3/2000 Rawlins et al. ..... 343/702
6,288,681 B1 * 9/2001 Kim et al. ..... 343/702

FOREIGN PATENT DOCUMENTS

| | | |
|---|---|---|
| EP | 0 372 720 | 6/1990 |
| JP | 9-260923 | 10/1997 |
| JP | 11-112219 | 4/1999 |

OTHER PUBLICATIONS

Patent Abstracts of Japan, JP 09–148826, Jun. 6, 1997.

* cited by examiner

*Primary Examiner*—Hoanganh Le

(57) ABSTRACT

An antenna device is provided with a transmission and reception antenna unit. The transmission and reception antenna unit includes an excitation antenna which is mounted on an antenna mounting section of the housing and a helical antenna which is electrically connected to the excitation antenna and can displace with respect to the excitation antenna. A shaft stands in an internal space of the excitation antenna, the helical antenna is adapted to displace along the shaft. In this manner, before the transmission and reception antenna unit is attached to the housing, it is possible to confirm the operation of the unit independently. Furthermore, it is possible to use a region directly under the excitation antenna as a designated region for the rechargeable battery. As a result, it is possible to improve the capacity of the rechargeable battery.

8 Claims, 9 Drawing Sheets

ANTENNA AND MOBILE RADIO UNIT

TECHNICAL FIELD

The present invention relates to an antenna device adapted for use with a portable wireless device of which a cellular phone is a representative example, and a portable wireless device.

BACKGROUND ART

A conventional example of an antenna device used in a portable wireless device of which a cellular phone is a representative example is arranged on the top of a housing and adapted to be withdrawn therefrom. This type of antenna device displays excellent antenna characteristics and is adapted for use as a portable unit since the antenna device can be stored in the housing when not in use and withdrawn from the housing when in use.

FIG. 10 is a rear view showing the structure of a cellular phone using a conventional antenna device. The conventional antenna device is provided for example on the left side of the cellular phone when viewed from the rear surface of the cellular phone. The antenna device is provided with a tubular excitation antenna 90 and a columnar helical antenna 91. The excitation antenna 90 is fixed to an antenna mounting section 92*a* which is a section of the housing 92. The helical antenna 91 can displace in an interior space of the excitation antenna 90 along an axial direction A. An antenna support shaft 93 is mounted on the lower end of the helical antenna 91. The antenna support shaft 93 is supported in a predetermined position by a holder 94 which is fixed to the housing 92.

In this manner, the antenna device has two antenna components of the excitation antenna 90 and the helical antenna 91 and each antenna is mounted on the housing 92 at respectively different positions. That is to say, the excitation antenna 90 is supported by the antenna mounting section 92*a* and the helical antenna 91 is supported by the holder 94. Therefore, the operation of the antenna device can not be confirmed until after attaching the antenna device to the housing. That is to say, it is not possible to confirm the operation of the antenna device independently.

The helical antenna 91 can be stored in a storage position as shown by the broken line in FIG. 10 from the position shown by the two-dot chain line. Furthermore, the helical antenna 91 can be drawn out from the storage position to the position shown by the two-dot chain line. In this time, the antenna support shaft 93 displaces together with the displacement of the helical antenna 91. Thus, when the helical antenna 91 is stored in the storage position, the antenna support shaft 93 extends below the excitation antenna 90.

As a result, in the conventional antenna device, a region directly below the excitation antenna 90 must be provided as a displacement region for the antenna support shaft 93. In other words, the displacement region for the antenna support shaft 93 splits the storage region for the battery pack 95 attached to the rear surface of the cellular phone. Thus, the problem has arisen that increases in the capacity of the rechargeable battery 96 are limited as a result of limitations on the size of the rechargeable battery 96 mounted in the battery pack 95.

FIG. 11 is a cross sectional view showing the internal structure of a cellular phone using the conventional antenna device as viewed from the bottom side thereof. As clearly shown in FIG. 11, the designated region for the rechargeable battery 96 avoids a displacement region for the antenna support shaft 93 in order to maintain the displacement region for the antenna support shaft 93. As a result, difficulties in increasing the capacity of the chargeable battery 96 have been encountered. This problem is particularly conspicuous with respect to antenna devices used in a satellite cellular phone which consumes relatively large amount of electrical power.

The present invention is proposed to solve the above problems and has the object of providing an antenna device which is adapted for use with a portable wireless device and which allows confirmation of the operation independently.

The present invention has the further object of providing a portable wireless device which can use the above antenna device even when a displacement region for a moveable antenna is not provided directly below the antenna device.

DISCLOSURE OF THE INVENTION

In order to achieve the above objects, an antenna device of the present invention comprises a first cylindrical antenna and a second cylindrical antenna which is fittingly inserted into the first antenna to allow displacement and electrical connection to the first antenna. A shaft which extends along a displacement direction of the second antenna is provided in an internal space of the first antenna. An antenna retaining section is provided at a fixed position on the shaft in order to retain the second antenna to a fixed displacement position.

According to the present invention, the shaft is arranged in an internal space of the first antenna and the second antenna can displace along the shaft. Thus, it is possible to integrate these antenna devices into a single unit. As a result, it is possible to confirm operation of the antenna device independently before mounting the antenna device onto the housing of the portable wireless device.

Furthermore, the second antenna displaces along the shaft provided in the internal space of the first antenna. Therefore, even when the second antenna is stored in a storage position, it is not necessary to maintain a displacement region for components related to the antenna in the region directly below the first antenna. As a result, when the antenna device is used in a portable wireless device, it is possible to use the region directly below the first antenna as a part of the designated region for the rechargeable battery. Thus, the capacity of the rechargeable battery can be increased.

BEST MODE FOR CARRYING OUT THE INVENTION

In order to describe the invention in greater detail, the preferred embodiments will be outlined below with reference to the accompanying figures.

Embodiment 1

Figure 1:
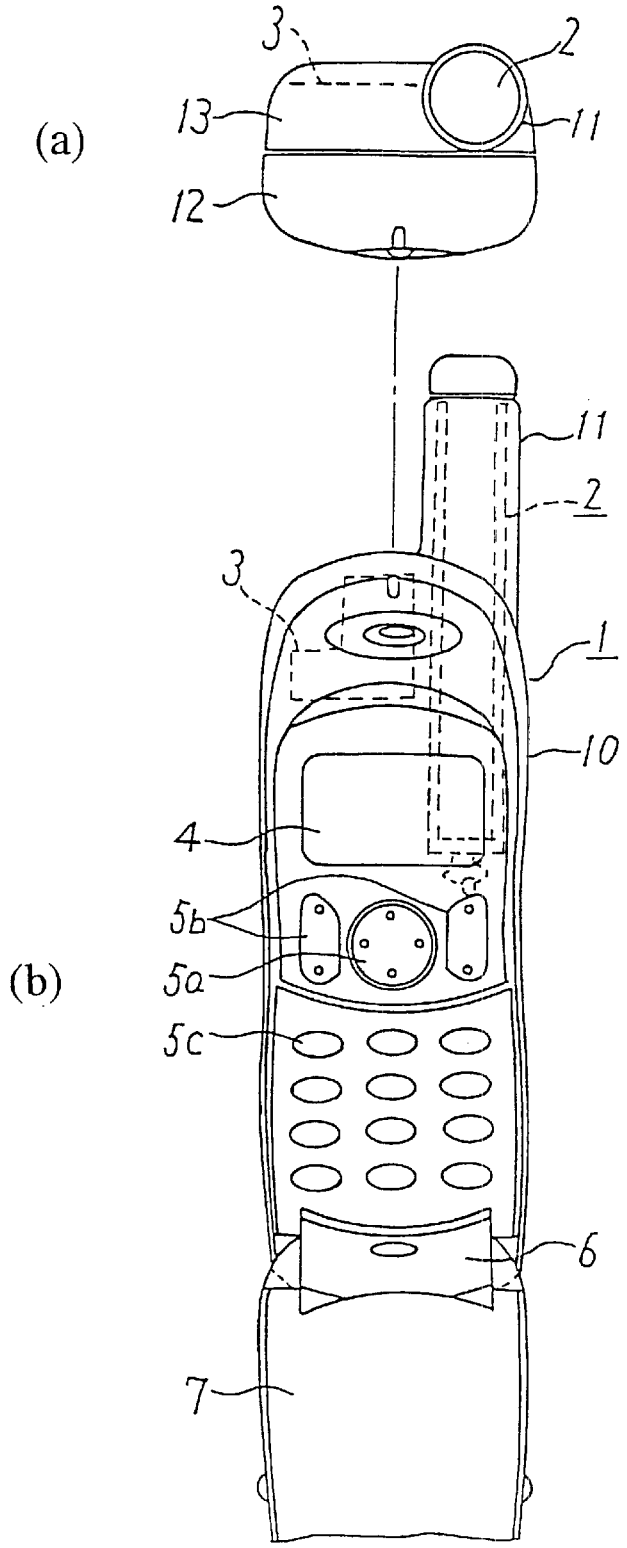
FIGS. 1*a* and *b* show the structure of a cellular phone according to a first embodiment of the present invention.

FIG. 1 shows the outer structure of a cellular phone according to a first embodiment of the present invention. FIG. 1(*a*) is a plan view of the cellular phone, FIG. 1(*b*) is a front view of the cellular phone. The cellular phone is a dual-mode terminal which can be used with, for example, a satellite cellular phone system and a terrestrial cellular phone system. For example, the terrestrial cellular phone system may be a PDC (Personal Digital Cellular) system, a GSM (Global System for Mobile communications) system or a CDMA (Code Division Multiple Access) system. The cellular phone realizes mobile communication by transmitting and receiving radio waves to or from a communication satellite orbiting in an orbit tens of thousands of kilometers above the earth or by transmitting and receiving radio waves with a base station on the ground.

The cellular phone is provided with a housing 1, a transmission and reception antenna unit 2 for the satellite cellular phone system which is attached to the housing 1, a transmission and reception antenna 3 for the terrestrial cellular phone system which is arranged in an upper portion of the housing 1, a display unit 4 which is provided on a surface of the housing 1, and a key operation section 5 which is provided on the surface of the housing 1. The key operation section 5 has a plurality of keys such as a function key 5*a,* a scroll key 5*b* and a ten-key 5*c*. A flap cover 7 is mounted on the lower end portion of the housing 1 by a mounting member 6. The flap cover 7 is opened as shown in FIG. 1 when in use and closed so as to cover the ten-key 5*c* when not in use.

The housing 1 is formed for example from ABS (Acrylonitrile Butadien Styrene) resin. The housing 1 is provided with a housing main body 10 and a cylindrical antenna mounting section 11. The housing main body 10 is composed of a front housing section 12 and a rear housing section 13, the front housing section 12 is coupled with the rear housing section 13. The antenna mounting section 11 is arranged to project linearly from the upper end of the rear housing section 13. The antenna mounting section 11 is disposed on the right side when the cellular phone is viewed from the front. Furthermore, the antenna mounting section 11 is formed in a shape which bulges slightly from the rear face of the housing main body 10.

Figure 2:
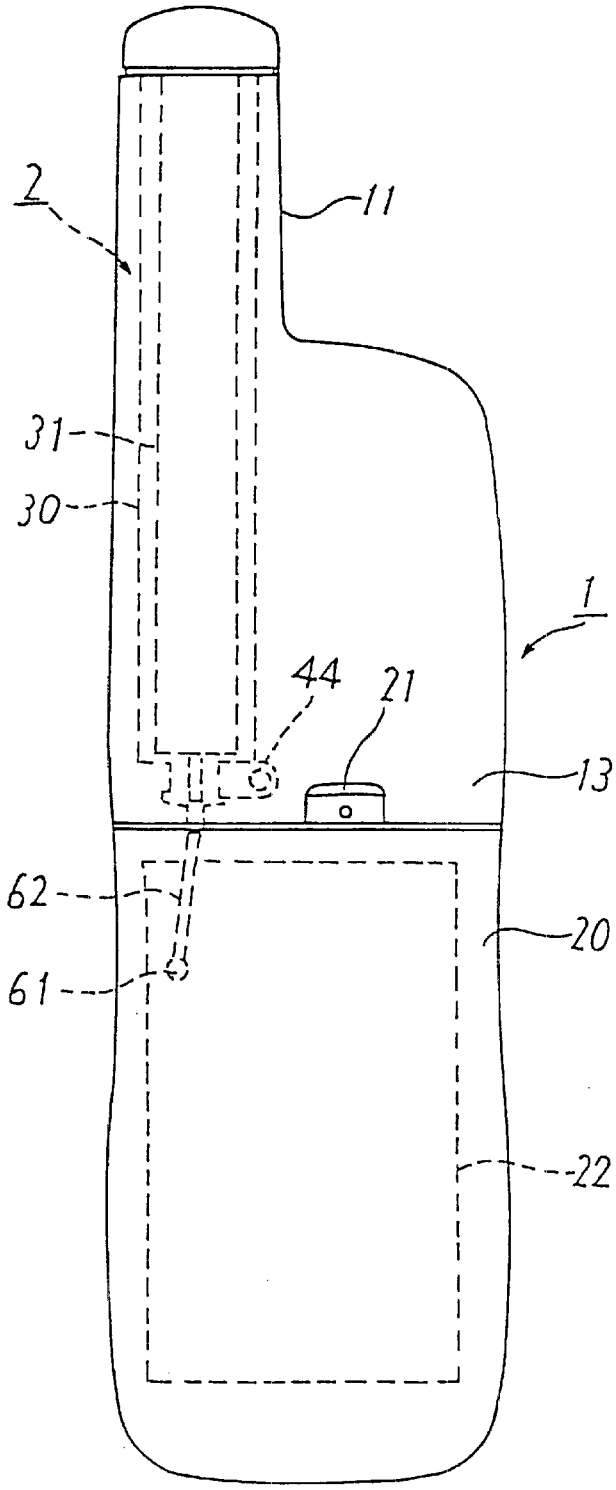
FIG. 2 is a rear view showing the structure of the cellular phone.

FIG. 2 is a rear view showing the outer structure of the cellular phone. The cellular phone is provided with a battery pack 20. The battery pack 20 is detachably mounted on the housing 1. More precisely, the mounted battery pack 20 constitute a part of the housing 1, that is to say, a part of the rear housing section 13. The battery pack 20 supplies electrical power to each section of the cellular phone. A detaching pin 21 is provided on an upper end portion of the battery pack 20.

The battery pack 20 is provided with a rechargeable battery 22 which acts as a power generation source. The rechargeable battery 22 is arranged on an inner side of the battery pack 20. The size of the rechargeable battery 22 is set to occupy a majority of the battery pack 20. In other words, the rechargeable battery 22 occupies almost half the rear face of the cellular phone. That is to say, a region directly under the transmission and reception antenna unit 2 is also occupied by the rechargeable battery 22.

Figure 3:
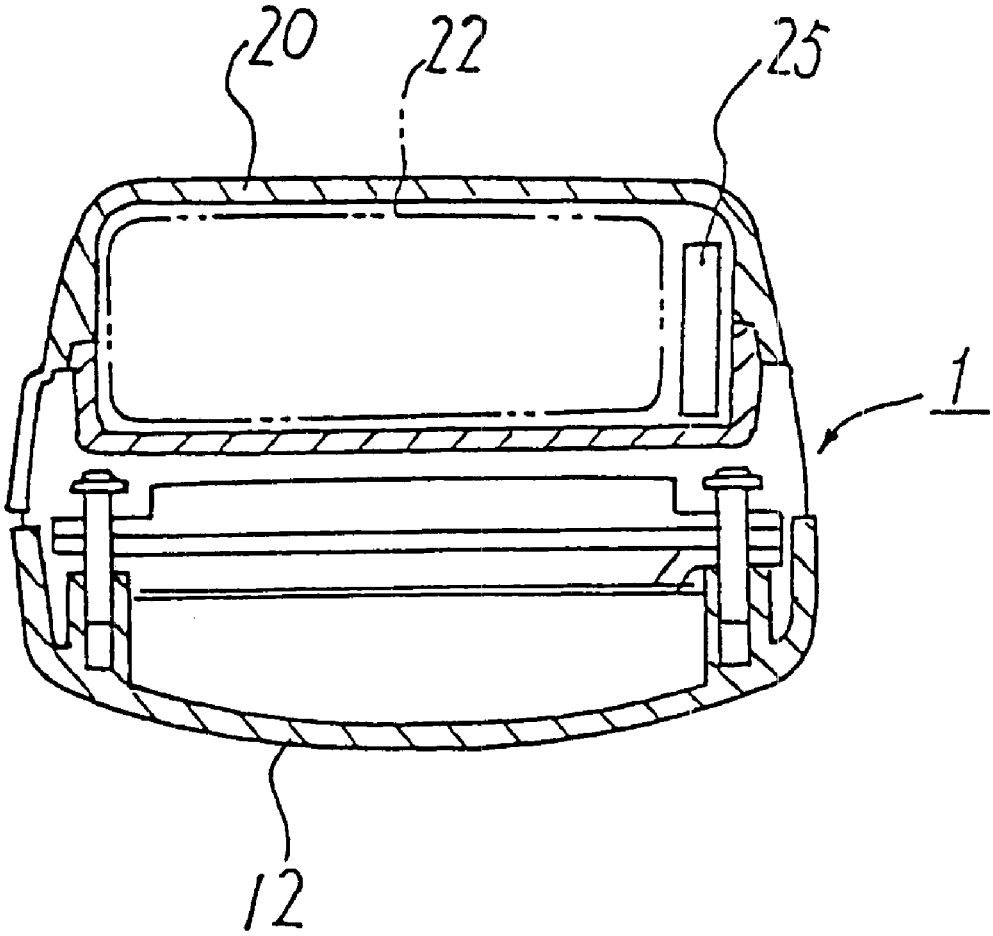
FIG. 3 is a cross sectional view showing the internal structure of the cellular phone as viewed from the bottom.

FIG. 3 is a cross sectional view showing the internal structure of a cellular phone as viewed from the bottom. As described above, the cellular phone is provided with a battery pack 20. The rechargeable battery 22 provided in the battery pack 20 occupies almost all of the transverse width of the battery pack 20. Reference numeral 25 denotes a protection circuit for protecting each section of the cellular phone from electrical phenomena.

Figure 4:
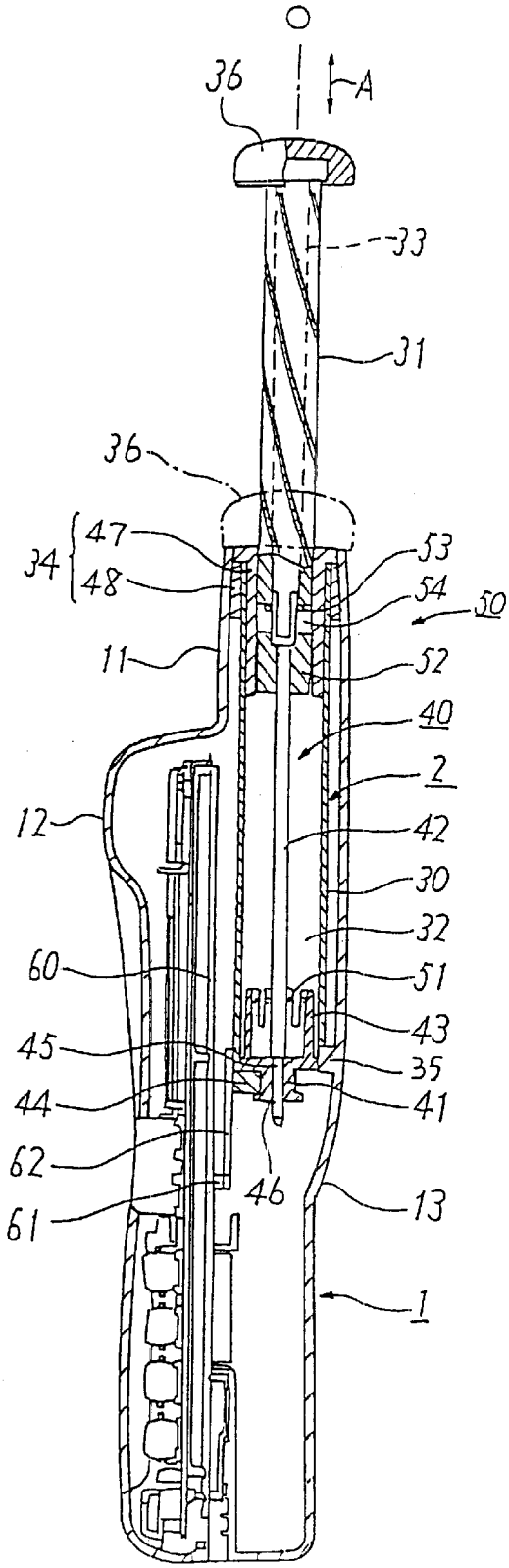
FIG. 4 is a cross sectional view showing the internal structure of the cellular phone.

FIG. 4 is a cross sectional view showing the internal structure of a cellular phone. The transmission and reception antenna unit 2 is constituted by an excitation antenna 30 which corresponds to the first antenna and a helical antenna 31 which corresponds to the second antenna. The excitation antenna 30 is securely attached to the housing 1. The helical antenna 31 is electrically coupled to the excitation antenna 30 and can displace with respect to the excitation antenna 30.

The excitation antenna 30 and the helical antenna 31 are both cylindrical in shape and are disposed coaxial to a single central axis O. That is to say, the excitation antenna 30 has an antenna storage space 32 which acts as a first internal space. The space 32 extends in an axial direction A along the central axis O. The helical antenna 31 has a shaft storage space 33 which acts as a second internal space and is formed along the axial direction A. The helical antenna 31 is inserted into the antenna storage space 32 of the excitation antenna 30 and can be withdrawn therefrom. The helical antenna 31 is adapted to displace with respect to the excitation antenna 30. The shaft storage space 33 is a space which allows insertion of a shaft 42 which is described below.

The excitation antenna 30 is mounted on the antenna mounting section 11 by a guide member 34 and is fixed to the housing 1 at a specified position by a positioning projection 35. The guide member 34 is press fitted to the antenna mounting section 11 and constitutes a part of a displacement guide section which is described below. The positioning projection 35 projects from the rear housing section 13. The lower end of the fixed excitation antenna 30 is positioned at approximately a central portion of the rear housing section 13 with reference to the axial direction A. In other words, the lower end of the excitation antenna 30 is located near the upper end of the battery pack 20 (refer to FIG. 2).

The helical antenna 31 can displace along an axial direction A within the antenna storage space 32 provided in the excitation antenna 30. More precisely, the helical antenna 31 can displace along the axial direction A between the excitation position (withdrawn position) shown by the solid line and the storage position shown by the two-dot chain line. A elastic member 36 is attached to the tip of the helical antenna 31. The elastic member 36 limits the displacement of the helical antenna when the helical antenna 31 is retracted and absorbs shocks at that time. Furthermore, it can be used as a handle when drawing out the helical antenna 31.

The transmission and reception antenna unit 2 is further provided with a bush 41, a shaft 42 and a guide member 34. The bush 41 is formed by a resin which has no influence on antenna characteristics. The bush 41 is fitted to a lower end portion of the excitation antenna 30. The bush 41 is provided with a cylindrical section 43 which is located within the antenna storage space 32 when fitted. The upper end of the cylindrical section 43 is opened. The bush 41 stores a section near to the lower end portion of the helical antenna 31 in an internal space of the cylindrical section 43. The reference numeral 44 denotes a holder which supports the bush 41 to strengthen the fixed position of the bush 41 on the excitation antenna 30.

The shaft 42 is formed by a resin which has no influence on the antenna characteristics. The shaft 42 is arranged in the antenna storage space 32 of the excitation antenna 30 to extend along the axial direction A which corresponds to the displacement direction of the helical antenna 31. The shaft 42 is fixed to the bush 41 so that the shaft is arranged uprightly within the antenna storage space 32 provided in the excitation antenna 30. Further, the shaft 42 is inserted into the shaft storage space 33 of the helical antenna 31 and is prevented from being revolved with respect to the helical antenna 31.

To describe this in further detail, a support hole 45 which extends from the bottom face of the cylindrical section 43 to the lower end of the bush 41 is formed in the bush 41. The shaft 42 is fixed to the bush 41 with the lower end portion of the shaft 42 retained in the support hole 45. In other words, the shaft 42 is fixed to the excitation antenna 30 which is fitted to the bush 41. The reference numeral 46 denotes a push nut for reinforcing the fixation of the shaft 42. The shaft 42 fixed to the excitation antenna 30 is inserted into the shaft storage space 33 of the helical antenna 31 and the helical antenna 31 can displace along the shaft 42.

The guide member 34 is adapted to attach the excitation antenna 30 to the antenna mounting section 11 and allow the displacement of the helical antenna 31 along the shaft 42 without deviation. More precisely, the guide member 34 is press fitted into the antenna mounting section 11. The guide member 34 has a cylindrical guide main section 47 and an antenna attachment section 48 which is integrally formed on one end of the guide main section 47. The antenna attachment section 48 faces the outer peripheral surface of the guide main section 47 with a fixed interval space and has a mounting groove (not shown) which is fitted with a fixing projection (not shown) provided on the excitation antenna 30. The excitation antenna 30 is attached to the guide member 34 in a state where the excitation antenna 30 is inserted into a space between the guide main body 47 and the antenna attachment section 48. That is to say, the guide main body 47 is located on an inner side of the excitation antenna 30, the antenna attachment section 48 is located on an outer side of the excitation antenna 30.

The length in a longitudinal direction of the guide main body 47 is set to a predetermined value. More precisely, the length of the guide main body 47 is set so that the guide main body 47 extends from the tip of the guide main body 47 to near the lower end of the helical antenna 31 when the helical antenna 31 is in an excitation position as shown by the solid line in FIG. 4. In this manner, inclination of the helical antenna 31 can be prevented when the helical antenna 31 is displaced.

The transmission and reception antenna unit 2 is provided with an antenna retainer 50. The antenna retainer 50 is correlated with a predetermined position on the shaft 42 to retain the helical antenna 31 in a predetermined displaced position. More precisely, the antenna retainer 50 is provided at a position which corresponds to the storage position and excitation position of the helical antenna 31, and the helical antenna 31 is retained at two positions corresponding to the storage position and the excitation position. In this way, the helical antenna 31 can be accurately stopped at the two positions corresponding to the storage position and the excitation position.

The antenna retainer 50 has a first engagement claw 51 which is provided displaceably on the bush 41, a first engagement groove 52 which is formed on an outer peripheral surface of the helical antenna 31, a second engagement claw 53 which is provided displaceably on the shaft 42, and a second engagement groove 54 which is formed on an inner peripheral surface of the helical antenna 31, namely, on the peripheral face defining the shaft storage space 33. This arrangement allows formation of the antenna retainer 50 with a simple structure.

When the helical antenna 31 is located in a storage position as shown by the two-dot chain line in FIG. 4, the first engagement claw 51 is engaged with the first engagement groove 52. On the other hand, when the helical antenna 31 is located in an excitation position as shown by the solid line in FIG. 4, the second engagement claw 53 is engaged with the second engagement groove 54. In this manner, the helical antenna 31 is retained in the storage position and in the excitation position. This is described in detail below.

Furthermore, the cellular phone is provided with a circuit board 60. Various circuits which process signals transmitted to and received from the transmission and reception antenna unit 2 are mounted on the circuit board 60. A coaxial connector 61 is also mounted on the circuit board 60, a coaxial cable 62 is connected to the coaxial connector 61. The other end of the coaxial cable 62 is soldered near to the lower end of the excitation antenna 30. That is to say, transmission and reception of the signal between the circuits on the circuit board 60 and the transmission and reception antenna unit 2 is effected through the coaxial connector 61 and the coaxial cable 62.

Figure 5:
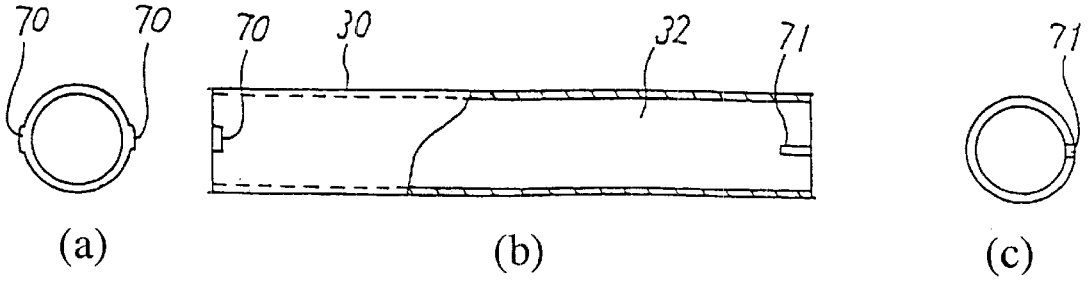
FIGS. 5*a, b* and *c* show the structure of an excitation antenna.

FIG. 5 shows the structure of an excitation antenna 30. FIG. 5(*a*) is a plan view showing the structure of the excitation antenna 30, FIG. 5(*b*) is a front view of the excitation antenna 30, and FIG. 5(*c*) is a bottom view of the excitation antenna 30.

As described above, the excitation antenna 30 has a cylindrical shape. A plurality of fixing projections 70 project from the outer peripheral surface in the tip portion of the excitation antenna 30. For example, two fixing projections 70 are provided facing each other. The fixing projections 70 are fitted into the mounting grooves formed in the antenna attachment section 48 of the guide member 34 when the excitation antenna 30 is attached to the guide member 34. In this manner, the excitation antenna 30 is attached to the guide member 34. Furthermore, a positioning engagement groove 71 is formed on the outer peripheral surface in the lower end portion of the excitation antenna 30. The positioning engagement groove 71 is engaged with the positioning projection 35 projecting from the rear housing section 13 when positioning the excitation antenna 30.

Figure 6:
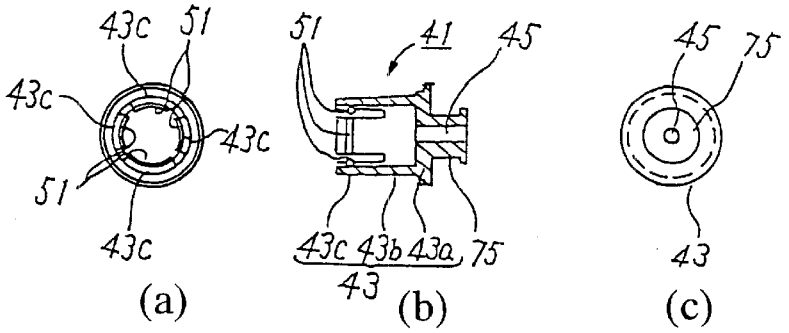
FIGS. 6*a, b* and *c* show the structure of a bush.

FIG. 6 shows the structure of a bush 41. FIG. 6(*a*) is a plan view showing the structure of the bush 41, FIG. 6(*b*) is a cross sectional view showing the structure of the bush 41, and FIG. 6(*c*) is a bottom view showing the structure of the bush 41.

As described above, the bush 41 is fitted to the lower end portion of the excitation antenna 30 to support the shaft 42 and also stores the helical antenna 31. The bush 41 is provided with a cylindrical section 43 and a support section 75 which is integrated with the cylindrical section 43. The cylindrical section 43 is composed of a bottom face section 43*a*, a base section 43*b* which is integrated with the edge portion of the bottom face section 43*a*, and four arcuate sections 43*c* which are integrally formed with the base section 43*b*. First engagement claws 51 respectively project from the inner surface of the arcuate sections 43*c*. As shown in FIG. 6(*a*), the first engagement claw 51 has an arcuate shape when viewed from in plan. The first engagement claw 51 can undergo elastic displacement along a radial direction when viewed from in plan.

The support section 75 is integrated with the bottom face section 43*a* of the cylindrical section 43 and has a cylindrical shape with a smaller radius than that of the cylindrical section 43. The support section 75 has a support hole 45 which passes through from the bottom section 43*a* of the cylindrical section 43 to the lower end of the support section 75. The support hole 45 retains the shaft 42 as described above.

Figure 7:
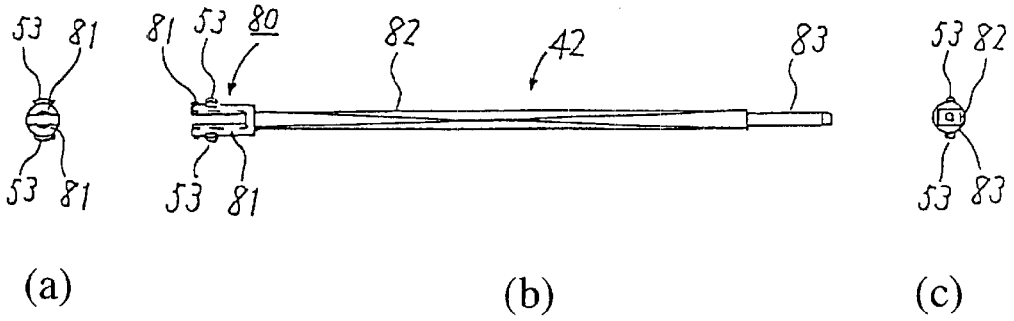
FIGS. 7*a, b* and *c* show the structure of a shaft.

FIG. 7 shows the structure of a shaft 42. FIG. 7(*a*) is a plan view showing the structure of the shaft 42, FIG. 7(*b*) is a front view showing the structure of the shaft 42, and FIG. 7(*c*) is a bottom view showing the structure of the shaft 42.

The shaft 42 narrows in a stepwise manner from the tip portion toward the lower end portion. More precisely, the tip portion of the shaft 42 takes the form of a stopper 80. The stopper 80 has two arcuate sections 81. Each arcuate section 81 has an arcuate shape viewed from in plan as shown in FIG. 7(*a*) and are disposed facing each other. A second engagement claw 53 having an arcuate shape when viewed in plan is provided respectively on an outer surface of each arcuate section 81. As described above, the second engagement claws 53 are engaged with the second engagement grooves 54 of the helical antenna 31 when the helical antenna 31 is placed in an excitation position.

A square pole section 82 is provided on a lower end side of the stopper 80. More precisely, the square pole section 82 has a quadrilateral shape when viewed from the bottom. A retained section 83 is provided on a low end side of the square pole section 82. The retained section 83 is inserted into the support hole 45 of the bush 41.

Figure 8:
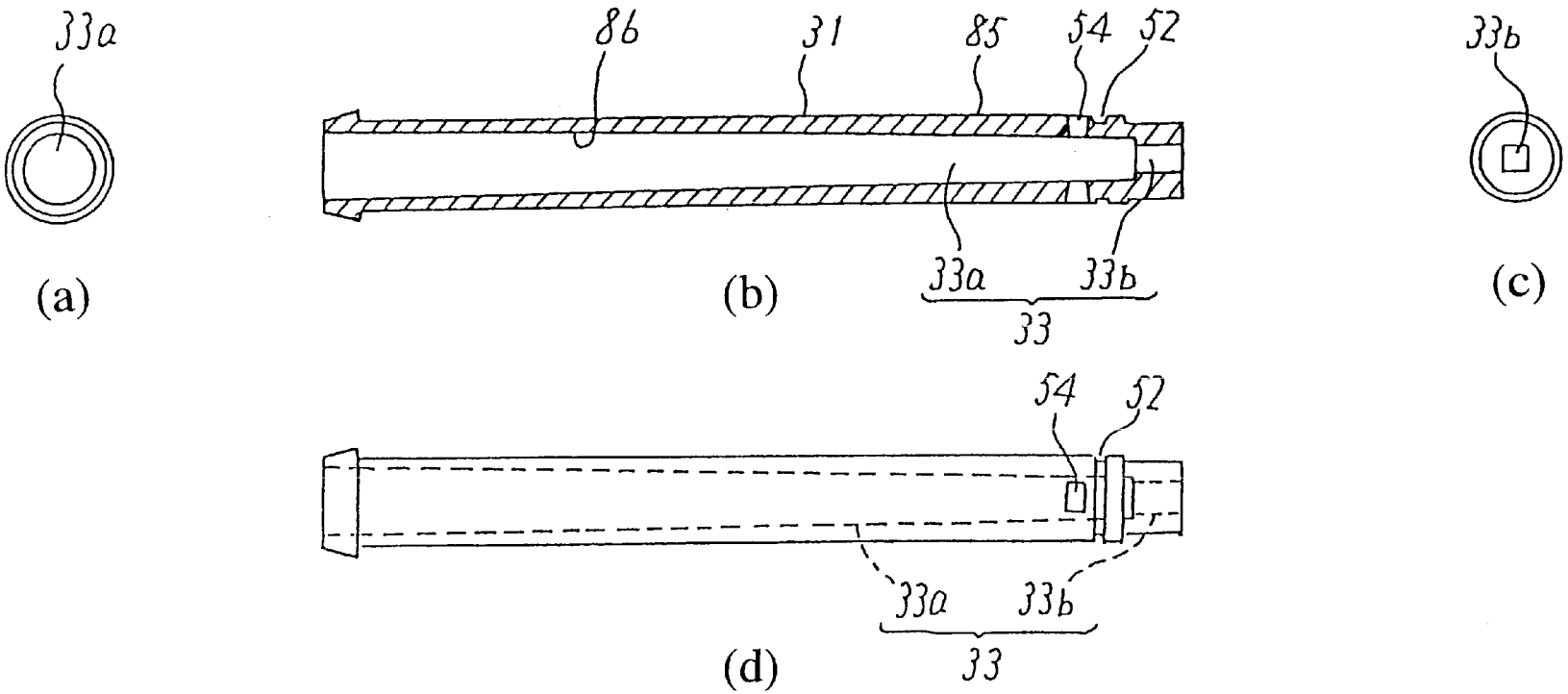
FIGS. 8*a–d* show the structure of a helical antenna.

FIG. 8 shows the structure of a helical antenna 31. FIG. 8(*a*) is a plan view showing the structure of the helical antenna 31, FIG. 8(*b*) is a cross sectional view showing the structure of the helical antenna 31, and FIG. 8(*c*) is a bottom view showing the structure of the helical antenna 31. FIG. 8(*d*) is a front view showing the structure of the helical antenna 31.

As described above, the helical antenna 31 has a cylindrical shape. The tip portion of the helical antenna 31 bulges outwardly in order to mount the elastic member 36. A first engagement groove 52 and a second engagement groove 54 are formed near to the lower end portion of the helical antenna 31. The first engagement groove 52 is formed on the outer peripheral surface near the lower end portion of the helical antenna 31. The first engagement groove 52 is formed in an annular shape. The first engagement groove 52 is engaged with the first engagement claws 51 provided on the bush 41 when the helical antenna 31 is stored in a storage position.

The second engagement grooves 54 are formed on a peripheral face 86 which defines the shaft storage space 33 of the helical antenna 31. The second engagement grooves 54 pass through from the shaft storage space 33 to the outer peripheral surface 85 of the helical antenna 31. The second engagement groove 54 has a rectangular shape when viewed from the front as shown in FIG. 8(*d*). In the first embodiment, two grooves 54 are provided. The second engagement grooves 54 are formed in a position opposing to each other. The second engagement grooves 54 are engaged with the second engagement claws 53 provided in the stopper 80.

Furthermore, as described above, a shaft storage space 33 is formed on an inner section of the helical antenna 31. The shaft storage space 33 extends from the tip to the lower end of the helical antenna 31. More precisely, the shaft storage space 33 is composed of a first shaft storage space 33*a* which extends from the tip portion to slightly before the lower end portion of the helical antenna 31 and a second shaft storage space 33*b* which extends from the first shaft storage space 33*a* to the lower end portion. The first shaft storage space 33a inclines and narrows from the tip portion towards the lower end portion of the helical antenna 31. That is to say, the peripheral face 86 defining the first shaft storage space 33*a* is formed in a tapering shape the radius of which decreases from the tip portion towards the lower end.

The second shaft storage space 33*b* is formed in a rectangular shape as shown in FIG.. 8(*c*) when the helical antenna 31 is viewed from the lower end. The size of the second shaft storage space 33*b* is slightly larger than that of the square pole section 82 of the shaft 42. Further, the size of the second shaft storage space 33*b* is set to a value which suppresses rotation or revolution of the shaft 42 along a circumferential direction of the helical antenna 41 when storing the shaft 42. In this manner, when displacing the helical antenna 31, rotation of the helical antenna 31 can be prevented and engagement of the second engagement claw 53 with the second engagement groove 54 can be ensured.

Figure 9:
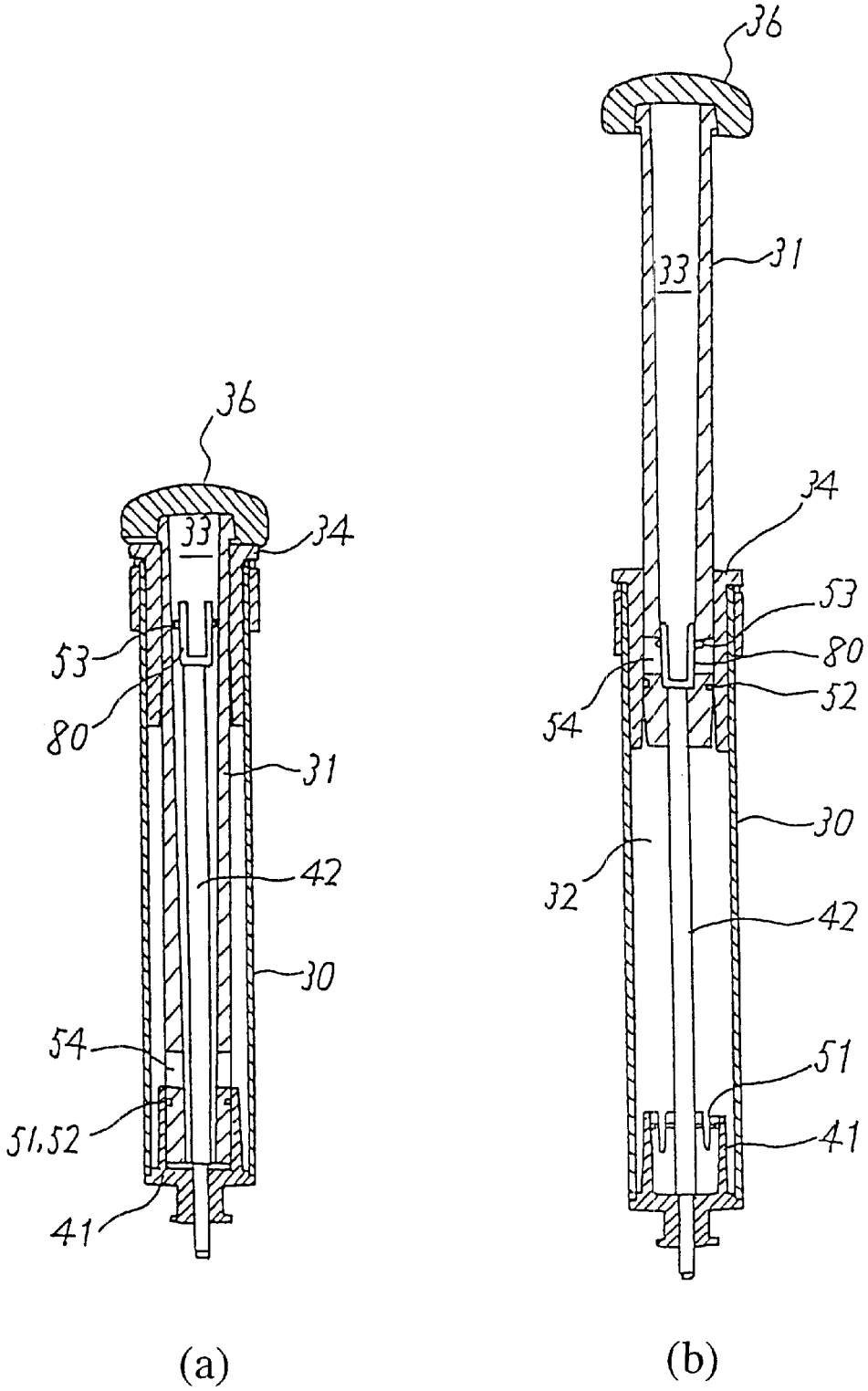
FIGS. 9*a* and *b* are cross sectional views showing the structure of a transmission and reception antenna unit in the storage position and in the excitation position.
Figure 10:
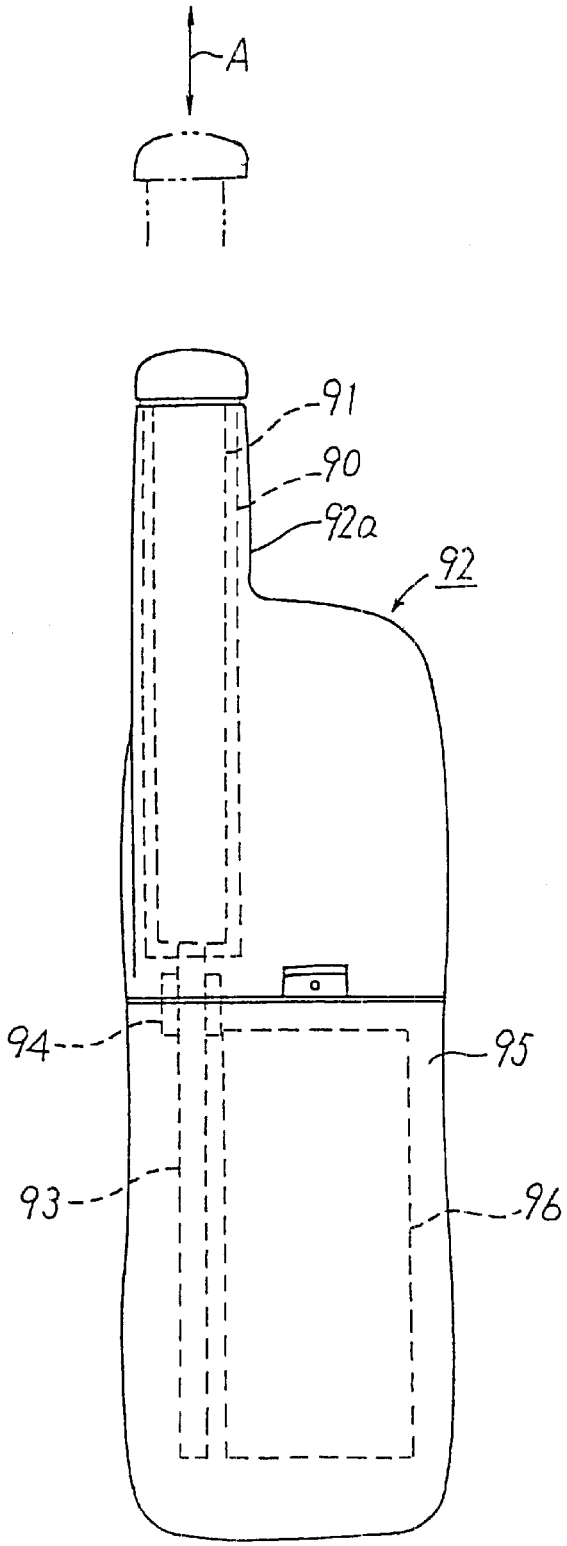
FIG. 10 is a rear view showing the structure of a cellular phone using a conventional antenna device.
Figure 11:
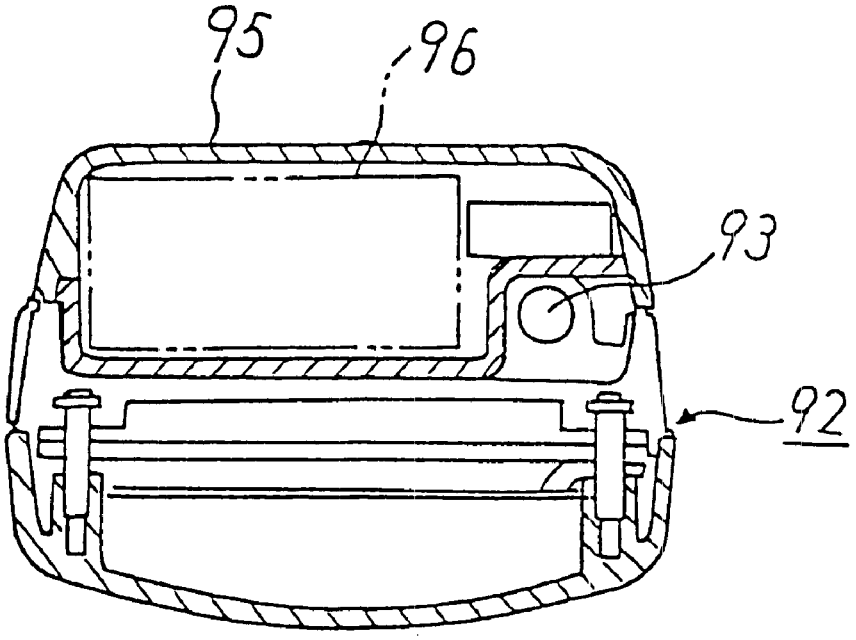
FIG. 11 is a cross sectional view showing the internal structure of the cellular phone using a conventional antenna device as viewed from the bottom.

FIG. 9 is a cross sectional view showing the structure of a transmission and reception antenna unit 2 in a storage position and an excitation position. FIG. 9(*a*) is a cross sectional view showing the structure of the transmission and reception antenna unit 2 when the helical antenna 31 is in the storage position. FIG. 9(*b*) is a cross sectional view showing the structure of the transmission and reception antenna unit 2 when the helical antenna 31 is in the excitation position.

When the helical antenna 31 is in a storage position, the helical antenna 31 is almost completely stored in an antenna storage space 32 of the excitation antenna 30. In this state, the first engagement claws 51 provided on the bush 41 are engaged with the first engagement groove 52 of the helical antenna 31.

In this state, the user can draw out the helical antenna 31 by holding the elastic member 36 mounted on the tip portion of the helical antenna 31. In this case, when the user draws the antenna out with more than a certain force, the first engagement claw 51 of the bush 41 is disengaged from the first engagement groove 52. Thus, it is possible to draw out the helical antenna 31.

When pulling up the helical antenna 31, the helical antenna 31 is drawn up along the shaft 42. Since the helical antenna 31 is not supported by the shaft 41, there is the possibility that the helical antenna 31 will incline. However, since the length of the guide member 34 which is provided between the helical antenna 31 and the excitation antenna 30 is relatively long, the guide member 34 prevents the helical antenna 31 from inclining.

Further, when pulling up the helical antenna 31, the helical antenna 31 is drawn up along the shaft 42. In this case, the second shaft storage space 33*b* of the helical antenna 31 is displaced along the square pole section 82 of the shaft 42. Therefore, the helical antenna 31 is drawn up without rotating along the circumferential direction.

Furthermore, since the shaft storage space 33*a* gradually narrows when viewed from the shaft 42, the stopper 80 is pressed by the helical antenna 31 which is drawn up to near the excitation position. As a result, the second engagement claws 53 of the stopper 80 are retracted. That is to say, the second engagement claws 53 come into contact with the peripheral face 86 defining the shaft storage space 33*a* for the first time when the helical antenna 31 reaches a position near the excitation position as a result of the peripheral face 86 being formed in a tapering shape. In this manner, wear on the second engagement claws 53 can be suppressed to a minimum.

Thereafter, when the helical antenna 31 reaches the excitation position, the second engagement claws 53 are engaged with the second engagement grooves 54 of the helical antenna 31. The engagement of the second engagement claws 53 with the second engagement grooves 54 is assisted by the helical antenna 31 being drawn up without rotating along the circumferential direction as described above. As a result, the helical antenna 31 stops at the excitation position.

Further, when retracting the helical antenna 31 from the excitation position to the storage position, the user presses the helical antenna 31 and inserts the helical antenna 31 into the excitation antenna 30. In this time, the second engagement claws 53 are disengaged from the second engagement grooves 54 and the helical antenna 31 is displaced in a downward direction. In this case, the helical antenna 31 is displaced without inclining due to presence of the guide member 34 and without rotating along the circumferential direction thereof.

When the helical antenna 31 reaches a position near the storage position, the first engagement claws 51 of the bush 41 are pressed by the outer peripheral surface of the helical antenna 31. Thereafter, when the helical antenna 31 reaches the storage position, the first engagement groove 52 is located at a position facing the first engagement claws 51 and the first engagement claws 51 are engaged with the first engagement groove 52. Thus, the helical antenna 31 is stopped at the storage position.

As described above, according to the first embodiment, the helical antenna 31 and the excitation antenna 30 are formed as a unit. Thus, before the transmission and reception antenna unit 2 is attached to the housing 1, it is possible to perform an operational check on the transmission and reception antenna unit 2 independently.

Furthermore, the helical antenna 31 is adapted to displace along the shaft 42 which is fixedly provided within the antenna storage space 32 of the excitation antenna 30. Thus, it is not necessary to use a region directly below the excitation antenna 30 as a region for antenna displacement. As a result, it is possible to use the region directly below the excitation antenna 30 as a part of the occupied region by the rechargeable battery 22 as shown in FIG. 2 and FIG. 3.

For that reason, the size of the rechargeable battery 22 can be increased in comparison to the conventional example and thus the capacity of the rechargeable battery 22 can be increased. For example, it is possible to increase the capacity of the rechargeable battery 22 by 30%. Therefore,it is possible to increase the stand-by time and the continuously communicable time of even satellite cellular phones which consume relatively large amount of electrical power.

Another Embodiments

Although an embodiment of the present invention has been described above, the present invention is not limited to the above embodiment. For example, the present embodiment has been described as adapted to a dual mode terminal used in a satellite cellular phone system and a terrestrial cellular phone system. However, the present invention may be adapted for example in a simple manner to a single mode terminal which is adapted for use with only a satellite cellular phone system.

Furthermore, in the above embodiment, an example of applying the present invention in a cellular phone has been described. However, it is possible to apply the present invention in a simple manner to portable wireless devices other than a cellular phone.

What is claimed is:

1. An antenna device comprising:

a first cylindrical antenna;

a second cylindrical antenna which is fittingly inserted into the first antenna to allow displacement and electrical connection to the first antenna;

a shaft disposed in an internal space of the first antenna and extending along a displacement direction of the second antenna; and an antenna retaining section disposed at a predetermined position on the shaft for retaining the second antenna in a predetermined displaced position.

2. The antenna device according to claim 1, wherein said antenna retaining section is arranged at positions corresponding to a withdraw position and a storage position of the second antenna.

3. The antenna device according to claim 1, further comprising a bush fitted to a lower end portion of the first antenna for supporting the shaft.

4. The antenna device according to claim 3, wherein said antenna retaining section comprises:

a first engagement claw arranged on the bush displaceably;

a second engagement claw arranged on the shaft displaceably;

a first engagement groove formed on an outer peripheral surface of the second antenna, the first engagement groove engaging with the first engagement claw when the second antenna is stored in a predetermined storage position; and a second engagement groove formed on an inner peripheral surface of the second antenna, the second engagement groove engaging with the second engagement claw when the second antenna is pulled up to a predetermined withdraw position.

5. The antenna device according to claim 1, wherein said shaft is inserted into said internal space so as not to displace along the circumferential direction with respect to an internal space of the second antenna.

6. The antenna device according to claim 1, wherein an inner peripheral surface of the second antenna has a tapering shape which narrows from a tip portion towards a lower end portion.

7. The antenna device according to claim 6, further comprising a guide member disposed between the first antenna and the second antenna and in a range from a tip portion of the first antenna to the lower end portion of the second antenna when the second antenna is withdrawn, said guide member guiding the displacement of the second antenna.

8. A portable wireless device comprising a housing, an antenna mounting section arranged to project from an upper end portion of the housing, an antenna device mounted on the antenna mounting section, and a battery pack detachably mounted on the housing and having a rechargeable battery, said antenna device comprising:

a first cylindrical antenna;

a second cylindrical antenna which is fittingly inserted into the first antenna to allow displacement and electrical connection with the first antenna;

a shaft disposed in an internal space of the first antenna and extending along a displacing direction of the second antenna; and an antenna retaining section disposed at a predetermined position on the shaft for retaining the second antenna in a predetermined displaced position, and said rechargeable battery being disposed in a region of the housing which includes a region directly below the antenna device.

* * * * *